United States Patent [19]

Gutzwiller

[11] Patent Number: 4,874,293

[45] Date of Patent: Oct. 17, 1989

[54] MODIFIED CENTRIFUGAL AIRFOIL FAN WHEEL

[76] Inventor: H. Leslie Gutzwiller, 308 Beaver St., Zelienople, Pa. 16063

[21] Appl. No.: 268,586

[22] Filed: Nov. 8, 1988

[51] Int. Cl.[4] ..... F04D 29/28

[52] U.S. Cl. ..... 416/184; 416/187

[58] Field of Search ..... 416/184, 187, 186 R

[56] References Cited

U.S. PATENT DOCUMENTS

| | | | |
|---|---|---|---|
| 629,121 | 7/1899 | Bicalky | 416/184 |
| 1,154,152 | 9/1915 | Williams | 416/186 R |
| 1,250,005 | 12/1917 | Phillips | 416/184 |
| 1,258,462 | 3/1918 | Rice | 416/184 |
| 1,877,347 | 9/1932 | McMurdie | 416/186 R |
| 1,985,705 | 12/1934 | Whiton | 416/184 |
| 2,653,755 | 9/1953 | Kruhmin | 416/184 |
| 3,144,204 | 8/1964 | Bohanon | 416/186 R |
| 3,245,611 | 4/1966 | White | 416/184 |
| 3,306,528 | 2/1967 | Eck | 416/218 |
| 3,426,965 | 2/1969 | Kulling | 416/184 X |
| 3,856,434 | 12/1974 | Hoffmann | 416/184 |

FOREIGN PATENT DOCUMENTS

| | | | |
|---|---|---|---|
| 994806 | 2/1983 | U.S.S.R. | 416/184 |
| 1298425 | 3/1987 | U.S.S.R. | 416/184 |
| 24629 | of 1909 | United Kingdom | 416/193 |

*Primary Examiner*—Everette A. Powell, Jr.

[57] ABSTRACT

A modified centrifugal airfoil fan wheel having a plurality of radially extending blades, a spaced back plate and front plate that interconnect each blade along the lateral edges of each blade, a center plate and a plurality of stiffeners. The center plate is spaced intermediate and parallel to the back and front plates and interconnect each blade along an intermediate portion. The plurality of stiffeners encircle and are secured to each blade at the outermost portion of the blades. The back plate, front plate and center plate each have a central concentric opening and each may have a cutout spaced between each blade. This modified design results in reduced stress during operation and an extended fatique life.

11 Claims, 2 Drawing Sheets

MODIFIED CENTRIFUGAL AIRFOIL FAN WHEEL

BACKGROUND OF THE INVENTION

1. Field of the Invention

This invention relates to centrifugal airfoil fan wheels, more particularly, this invention relates to a method for modifying a centrifugal airfoil fan wheel for improved performance and to prevent operational low cycle fatigue and the airfoil fan produced thereby.

2. Description of the Prior Art

Centrifugal airfoil fans are well known. Centrifugal airfoil fans are typically constructed of various materials and are designed to have an aerodynamic shape having varying wheel diameter and width depending upon the operational characteristics desired. Optimal design characteristics for centrifugal fans include reduced vibration, increased efficiency and reduced centrifugal force stresses. These design characteristics facilitate the practical use of smaller mounting shafts and bearings and smaller rated drive motors.

In any centrifugal fan design, the centrifugal fan, during operation, will experience steady state stresses which are relatively high when compared to the yield strength of the material utilized to make the fans. The steady state stresses are attributable to the combined twisting, bending and in-plane and torsional loads imposed upon the centrifugal fan wheels during operation. As a result of these operational stresses, many centrifugal fans will at some point in time experience low cycle fatigue which initially manifests itself in localized cracking, then crack propagation and eventual wheel failure. The low cycle fatigue condition is exacerbated by the frequent starting and stopping of the wheel, speed changes, and erosion and corrosion experienced by centrifugal fans. The operating life of the fan will be short and the fan may fail catastrophically when the stresses due to operation are very high relative to the yield strength of the material from which the fan is constructed. Because low cycle fatigue in centrifugal airfoil fans is cumulative and irreversible, it has been an accepted practice in the industry to replace a failing fan wheel thereby causing operational delays and additional expenses. Accordingly, applicant has invented a method for retrofitting a failing centrifugal airfoil fan wheel thereby allowing for the safe continued use of the fan wheel at a minimum loss of time and expense. A centrifugal fan wheel modified in accordance with the present invention is capable of operating at optimum efficiency and performance for an extended period of time.

It is an object of the present invention to provide an inexpensive method for retrofitting a failing centrifugal airfoil fan wheel.

It is yet another object of the present invention to provide a modified centrifugal airfoil fan wheel with lower operating stress levels than that of an unmodified airfoil fan wheel.

Another object of the present invention is to provide a modified centrifugal airfoil fan wheel of a sturdy construction having a reduced or substantially the same weight and inertia with lower operating stress levels than that of an unmodified airfoil fan wheel.

Another object of the present invention is to provide a modified centrifugal airfoil fan wheel capable of operating for an extended period of time.

SUMMARY OF THE INVENTION

In accordance with the present invention, I have invented a modified centrifugal airfoil fan wheel including a plurality of radially extending blades, a spaced back plate and front plate interconnecting each blade along the lateral edges of each blade and a center plate spaced intermediate and parallel to the back plate and the front plate. The center plate interconnects each blade along an intermediate portion thereof. Also included in the modified centrifugal airfoil fan wheel are a plurality of stiffeners encircling and secured to each blade at the outermost portion of the blades and a center plate having a central concentric opening and a cutout spaced between each blade.

It will be appreciated that the reduced weight and inertia of the modified airfoil fan resulting from the cutouts makes possible the application of additional strengthening members such as stiffeners and ribs to the airfoil fan without effecting the performance characteristics thereof.

DETAILED DESCRIPTION OF THE PREFERRED EMBODIMENTS

Figure 1:
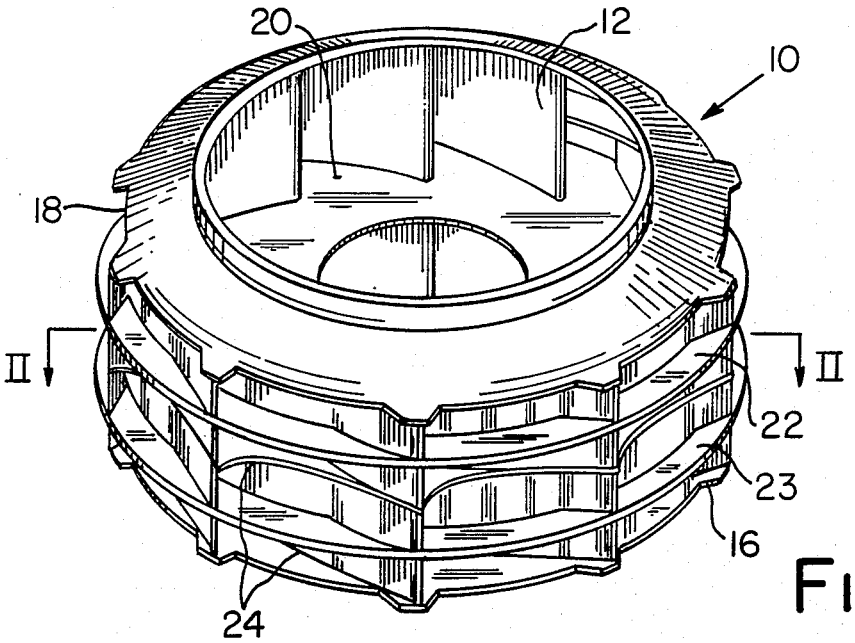
FIG. 1 is a perspective view of a modified centrifugal airfoil fan wheel.

Referring to the drawings wherein like reference characters represent like elements, FIGS. 1–4 illustrate a modified centrifugal airfoil fan produced in accordance with the present invention.

In reference to FIG. 1, there is shown an airfoil centrifugal fan 10 having radially extending airfoil shaped blades 12, a spaced back plate 16 and front plate 18, a center plate 20 spaced intermediate and parallel to the back plate and the front plate and at least two stiffeners 22 and 23 encircling and secured to the outermost portions of the blades. The front plate 18, back plate 16 and center plate 20 interconnect each blade 12 along the lateral edges and intermediate portion of each blade, respectively. The front plate 18, back plate 16 and center plate 20 each may have a cutout 24 therein spaced between each blade 12. The front plate 18, center plate 20, back plate 16 and stiffeners 22 and 23 constitute the supporting structure for the blades 12.

It will be appreciated that either a conventional centrifugal airfoil fan 10 may be modified in accordance with the present invention or a centrifugal airfoil fan may be manufactured in accordance with the present invention. As used herein, the term "outward" refers to a direction extending radially from the center of the fan wheel to the exterior of the fan wheel. Similarly, the term "inward" refers to a direction extending radially from the exterior of the fan wheel to the center of the fan wheel.

Figure 2:
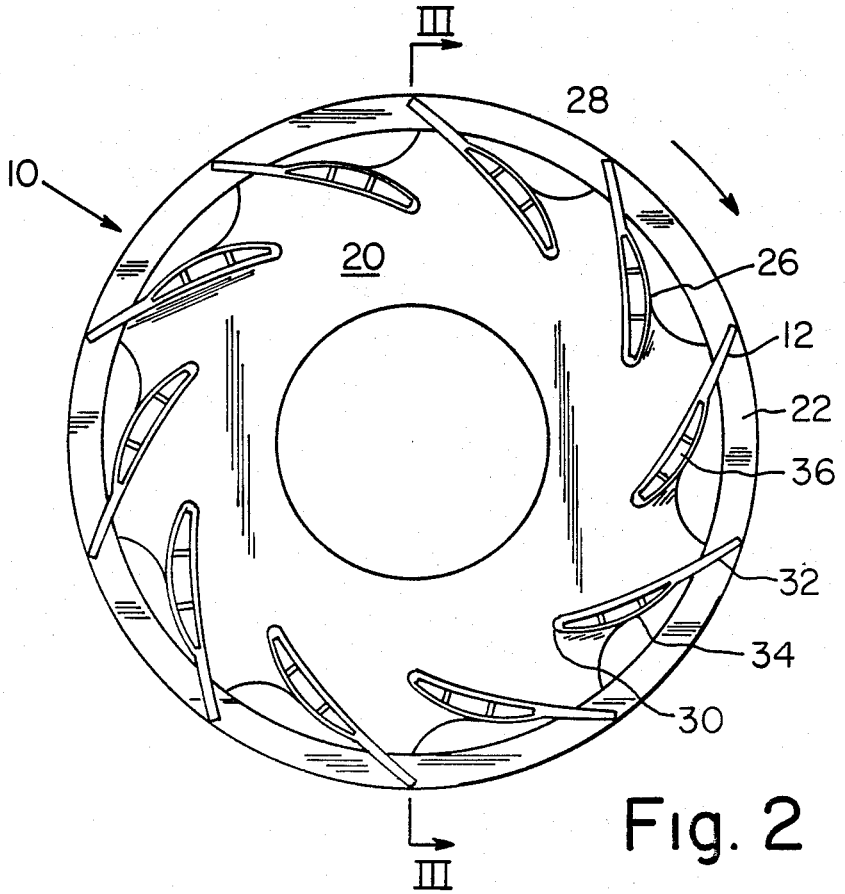
FIG. 2 is a sectional view taken along line 2—2 if FIG. 1.
Figure 4:
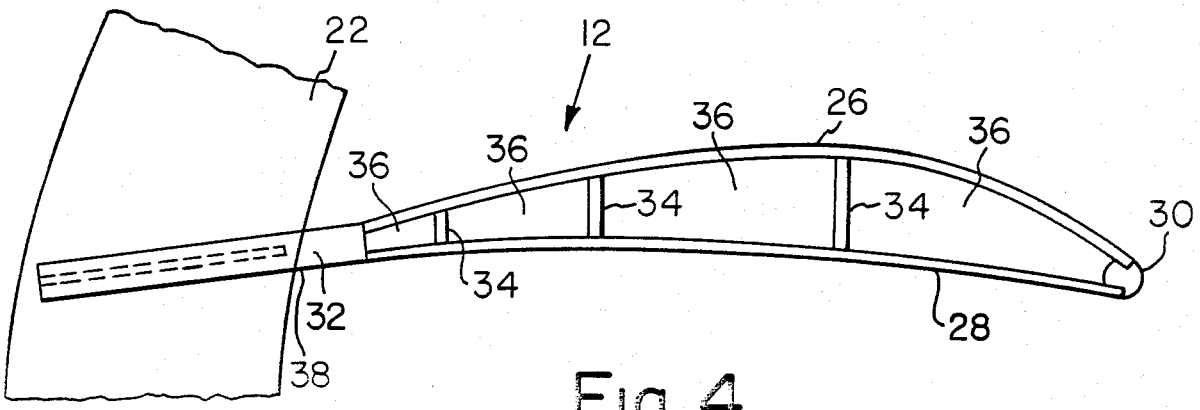
FIG. 4 is a top view of a modified blade.

The blades 12 are better shown in FIGS. 2 and 4. The blades 12 are angularly disposed at a predetermined angle from a radial position which constitutes the optimum angle for the particular application of the airfoil fan. The blades 12 are evenly spaced and in-line across the center plate 20 and between the back plate 16 and front plate 18. The blades 12 are formed in an airfoil shape having a top skin 26 and a bottom skin 28 joined at one end by a nosepiece 30 and at the opposing end by an optional tailpiece 32. Struts 34 extend between and secure the top skin 26 and bottom skin 28 in a spaced relation thereby defining hollow sections 36. The struts 34 provide an airfoil blade shape of increased structural rigidity. It will be appreciated that due to the reduced weight of the airfoil fan additional struts 34 may be added to the blade 12 to provide additional structural rigidity and thereby alleviate skin stress formed during operation of the centrifugal fan without altering the performance of the fan. Each blade tailpiece 32 has a longitudinal slot 38 cut therein to receive a stiffener to be more fully described herein. The slot is positioned chordwide of each blade 12.

The back plate 16 and front plate 18 are generally circular or disc shape and are fastened to each of the lateral edges of the radially extending airfoil blades 12, respectively. As shown in FIG. 1, the back plate 16 and front plate 18 each have concentric openings therein to accommodate an inlet gas stream. The back plate 16 and front plate 18 are often angled from the tip of each respective plate of the centrifugal fan outward to the inner circumferential edge of each plate of the centrifugal fan to form an angled rim to the back plate 16 and front plate 18 of the centrifugal fan. The back plate 16 and front plate 18 have cutouts 24 spaced between each angularly disposed blade 12, thereby reducing the weight and centrifugal forces exerted on the fan and allowing for the use of additional stiffeners and/or ribs without effecting the operational characteristics of the fan.

Figure 3:
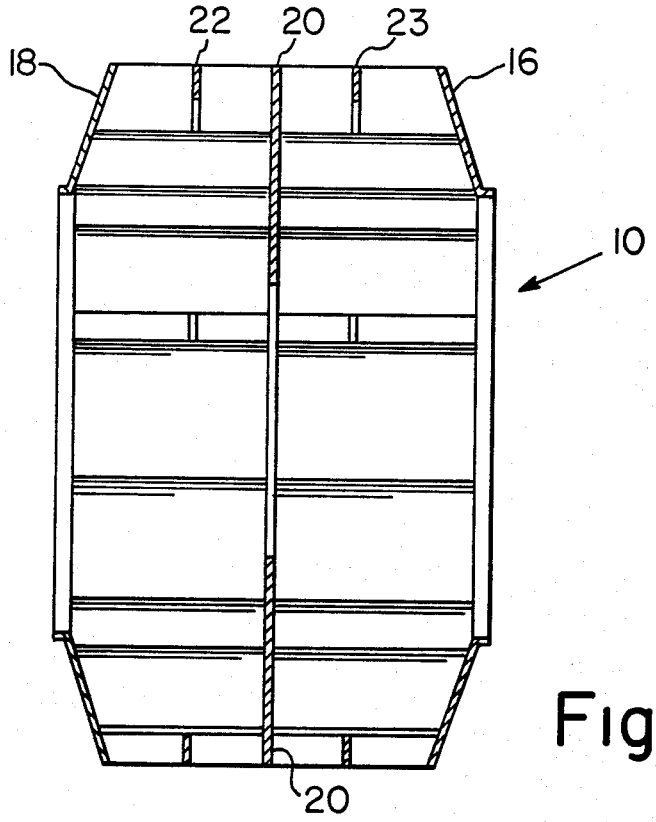
FIG. 3 is a sectional view taken along line 3—3 of FIG. 1.

The center plate 20 is also of a circular or disc shape having an opening aligned with the concentric openings of the back and front plates 16 and 18, respectively. As shown in FIGS. 2 and 3, the opening formed within the center plate is of a smaller diameter than the concentric openings of the back and front plates. The center plate 20 is spaced intermediate and generally parallel to the front and back plates. The center plate 20 is fastened to a middle portion of each blade 12 and at the inner most edge to a conventional hub of an axle of a centrifugal fan (not shown). In a preferred embodiment, the center plate 20 also includes cutouts 24 along the outside diameter thereof spaced between each blade 12 to reduce the overall weight and inertia created by a centrifugal fan to allow for the application of additional strengthening members to the fan without affecting the performance characteristics thereof.

It will be appreciated that the cutouts 24 may be of various sizes and shapes and may be placed in a variety of arrangements about the plates so long as the performance characteristics of the fan produced thereby are not adversely effected. By removing either a portion of the center plate 20 or front plate 18 or back plate 16, centrifugal fan 10 is created having an appreciably reduced weight. Because the cutouts 24 reduce the weight of the fan, stiffeners 22 and 23 may be added to the outer peripheral portions of each blade 12. The stiffeners, are secured within the longitudinal slot 38 formed within the optional tailpiece 32 of each blade 12. The stiffeners are positioned in a plane transverse to a central axis formed passing through the central concentric opening of the back plate, front plate and center plate. The stiffeners 22 and 23 are continuous rings and provide increased rigidity and structural support to the modified centrifugal airfoil fan 10, thereby reducing stress levels during fan operation.

As shown in FIGS. 1 and 3, two stiffeners 22 and 23 are uniformly spaced between the front plate 18 and back plate 16 and completely encircle the fan to provide increased support. The stiffeners 22 and 23 are of a width approximately equal to the radial length of the slot 38 formed within the tailpiece 32 of each blade 12.

The modified centrifugal fan produced in accordance with the present invention is manufactured from conventional materials such as high strength low alloy steels, quenched and tempered high strength alloy steels, and the like. The various components of the centrifugal fan may be interconnected by any suitable known method such as conventional welding techniques.

By removing a portion of the center plate, back plate and front plate between each blade, forming a slot in the tailpiece of each blade and adding a stiffener around the peripheral edges of the fan, a failing airfoil fan may be repaired without significantly effecting the air performance characterstics of the fan. It will be appreciated that an additional feature of the present invention as described herein is that the modifications may be performed in the field to a conventional centrifugal fan without extended machine downtime and expense.

Computer simulations of finite element stress analysis were first conducted on an unmodified airfoil fan having a material yield strength of approximately 100,000 P.S.I. and then on the same airfoil fan after the fan was modified in accordance with the present invention. The results of the finite analysis confirmed improved Von Mises wheel stress characteristics of the modified airfoil fan relative to an unmodified airfoil fan. For example, an unmodified airfoil wheel produced a maximum and a minimum Von Mises stress on the top skin of the blade of 131,382 P.S.I. and 10,135 P.S.I., respectively, and a modified airfoil wheel produced in accordance with the present invention resulted in a maximum and a minimum Von Mises stress on the top skin of the blade of 78,491 P.S.I. and 6,875 P.S.I., respectively. Similar improved results, as set forth in Table 1 and reported in P.S.I. units, were obtained for the bottom skin of the blade, tailpiece, center plate, stiffeners, ribs, nosepiece and shroud.

TABLE 1

| | VON MISES STRESS IN P.S.I. | | | |
|---|---|---|---|---|
| | UNMODIFIED AIRFOIL FAN | | MODIFIED AIRFOIL FAN | |
| | MAXIMUM | MINIMUM | MAXIMUM | MINIMUM |
| TOP SKIN OF BLADE | 131,382 | 10,135 | 78,491 | 6,875 |
| BOTTOM SKIN OF BLADE | 108,960 | 13,057 | 76,018 | 9,205 |
| TAILPIECE | 114,317 | 19,409 | 62,909 | 4,231 |
| CENTER PLATE | 38,369 | 9,288 | 42,161 | 558 |
| STIFFENERS | — | — | 58,195 | 22,131 |
| RIB 0 | — | — | 47,294 | 2,734 |

TABLE 1-continued

| | VON MISES STRESS IN P.S.I. | | | |
|---|---|---|---|---|
| | UNMODIFIED AIRFOIL FAN | | MODIFIED AIRFOIL FAN | |
| | MAXIMUM | MINIMUM | MAXIMUM | MINIMUM |
| RIB 1 | 58,070 | 6,971 | 49,066 | 3,537 |
| RIB 2 | 66,625 | 7,309 | 55,789 | 5,837 |
| RIB 3 | 111,650 | 8,447 | 61,961 | 7,266 |
| NOSE PIECE | 67,061 | 2,509 | 49,204 | 1,103 |
| SHROUD | 104,098 | 13,804 | 67,646 | 16,082 |

As shown in Table 1, the unmodified fan design experienced stress levels in excess of the material yield strength which resulted in plastic deformation and a short fatigue life. However, an airfoil fan modified in accordance with the present invention reduced cyclic stress levels below the material yield strength and increased low cycle fatigue life of the fan. More particularly, the modified airfoil fan as shown in Table 1 produced stress levels of only approximately 78% of the material yield strength to produce a fan of increased low cycle fatigue life having an acceptable design safety factor.

Having described a presently preferred embodiment of the invention, it is to be understood that it may be otherwise embodied within the scope of the appended claims.

I claim:

1. A centrifugal airfoil fan wheel comprising:

(a) a plurality of radially extending airfoil shaped blades, each blade having a tail and a nose, said tail having a slot formed within said tail longitudinal said blades;

(b) a spaced back plate and front plate interconnecting each blade along the full extent of the lateral edges of each blade;

(c) a circular center plate spaced intermediate and parallel to said back plate and said front plate and interconnecting each blade along an intermediate portion thereof such that said blades butt against said center plate from both sides; and (d) a plurality of stiffener rings encircling and secured to each blade at the outermost portion of said blades within said slots, said back plate, said front plate, and said center plate each having a central concentric opening and said center plate having a plurality of equally spaced cutouts therein, said stiffeners positioned in a plane transverse to an axis passing through said central concentric opening of said back plate, front plate and center plate.

2. The centrifugal airfoil fan wheel as set forth in claim 1, wherein said back plate and said front plate each have a plurality of cutouts spaced between each blade.

3. The centrifugal airfoil fan wheel as set forth in claim 2, wherein said back plate and said front plate include a plurality of equally spaced cutouts.

4. The centrifugal airfoil fan wheel as set forth in claim 1, wherein said center plate includes a plurality of cutouts spaced between each blade.

5. The centrifugal airfoil fan wheel as set forth in claim 1, wherein two stiffeners are uniformly spaced between said front plate and said back plate and secured to each blade at the outermost portion of said blades.

6. The centrifugal airfoil fan wheel as set forth in claim 5, wherein said stiffeners are secured within a longitudinal slot in each tailpiece of each blade.

7. The centrifugal airfoil fan wheel as set forth in claim 1, wherein said blades each have a top skin and a bottom skin joined at one end by a nosepiece and at the opposing end by a tailpiece and a plurality of struts extending between and securing said top skin and said bottom skin in a spaced relation to define an airfoil shape.

8. The centrifugal airfoil fan wheel as set forth in claim 7, wherein a plurality of struts extend between and secure said top skin and said bottom skin in a spaced relation to define an airfoil shape.

9. A method of modifying a failing airfoil fan wheel of the type having a plurality of radially extending blades, a spaced back plate and front plate interconnecting each blade along the lateral edges of each blade, a center plate spaced intermediate and parallel to said back plate and said front plate and interconnecting each blade along an intermediate portion comprising the steps of:

(a) forming a plurality of equally spaced cutouts around the periphery of the back plate and the front plate;

(b) forming a slot in the tailpiece of each blade; and (c) applying a circular stiffener around the peripheral edges of the fan within said slot parallel to the center plate such that the modified airfoil fan has substantially the same or reduced weight and substantially identical performance characteristics and inertia as a nonfailing airfoil fan.

10. The method of modifying a failing airfoil fan wheel as set forth in claim 9, wherein the plurality of cutouts are equally spaced between each blade around the periphery of the back plate and the front plate.

11. The method of modifying a failing airfoil fan wheel as set forth in claim 9, further comprising the step of forming a plurality of cutouts around the periphery of the center plate between each blade.

* * * * *